US011246435B1

(12) United States Patent
Beltre et al.

(10) Patent No.: US 11,246,435 B1
(45) Date of Patent: Feb. 15, 2022

(54) SEALED CUP WITH ELECTRO-MECHANICAL LID

(71) Applicant: Juan Beltre, Dix Hills, NY (US)

(72) Inventors: Juan Beltre, Dix Hills, NY (US); Khalid Mostafa, New Borg El Arab (EG)

( * ) Notice: Subject to any disclaimer, the term of this patent is extended or adjusted under 35 U.S.C. 154(b) by 0 days.

(21) Appl. No.: 17/191,827

(22) Filed: Mar. 4, 2021

(51) Int. Cl.
*A47G 19/22* (2006.01)
*B65D 47/08* (2006.01)

(52) U.S. Cl.
CPC ..... *A47G 19/2272* (2013.01); *B65D 47/0857* (2013.01)

(58) Field of Classification Search
CPC ..... A47G 19/2272; B65D 47/0857; B65F 1/1607; B65F 1/1638
USPC ..... 220/211; 318/480
See application file for complete search history.

(56) References Cited

U.S. PATENT DOCUMENTS

2004/0174268 A1* 9/2004 Scott ..... B65F 1/1638 340/686.6
2009/0194532 A1* 8/2009 Yang ..... B65F 1/1638 220/211
2011/0074316 A1* 3/2011 Shek ..... B65F 1/1607 318/3
2015/0259140 A1* 9/2015 Yang ..... B65F 1/1646 220/211
2018/0263392 A1* 9/2018 Phan ..... B65D 51/1644

* cited by examiner

*Primary Examiner* — Don M Anderson
*Assistant Examiner* — Madison L Poos
(74) *Attorney, Agent, or Firm* — Tatonetti IP

(57) ABSTRACT

A sealed cup with an electro-mechanical lid is implemented, which is configured to reduce the amount of exposure the lid and liquid reservoir have to the user's hands, and thereby germs. The cup includes a lower container inside which liquid (e.g., coffee, tea, soda, alcohol, etc.) can be poured for future consumption by the user. The cup includes an upper container that secures to the lower container, such as through corresponding threads that engage responsive to user turning. The upper container stores various electro-mechanical components, including a PCB (printed circuit board), processor, memory, motor, and gears, to enable opening and closing of the lid responsive to user input. The electro-mechanical components are protected via some internal housing components that prevent the liquid in the lower container from coming into contact with those components.

14 Claims, 9 Drawing Sheets

800

SEALED CUP WITH ELECTRO-MECHANICAL LID

BACKGROUND

Many coffee, tea, and liquid containers operate based on simplicity. For example, the liquid container may be connected to a lid, in which the lid can be removably attached to the container to pour liquids therein. The lid may have a separate opening or hole exposed by movement or manipulation of the lid to enable the user to access and consume the liquid inside the container. Relying on the lid to access the container's reservoir increases the opportunities to spread germs and bacteria, whether onto the lid's opening, inside the container, or around these components, which may end up being ingested by the user.

SUMMARY

A sealed cup with an electro-mechanical lid (hereinafter referred to as "cup," for short) is implemented, which is configured to reduce the amount of exposure the lid and liquid reservoir have to the user's hands, and thereby germs. The cup includes a lower container inside which liquid (e.g., coffee, tea, soda, alcohol, etc.) can be poured for future access by the user. The cup includes an upper container that secures to the lower container, such as through corresponding threads that engage responsive to user turning.

The upper container includes an internal container and an internal compartment. The internal container provides the flow path from the lower container to the upper container so that the user can drink the contents of the cup. The internal compartment is positioned laterally adjacent to the internal container. The internal container includes a base surface that blocks any liquids in the lower container from contacting the internal compartment. As the internal compartment houses and protects various electrical and mechanical components, the internal container's base surface helps prevent those components from being damaged by liquid. A seal wraps around the internal container and internal compartment to create a tight seal between the two components.

The cup includes a printed circuit board (PCB), battery, a hardware-based memory device, and a processor to control the lid's opening and closing responsive to user input. The upper container includes one or more buttons around its perimeter that the user can press, which triggers the lid's opening or closing about the upper container. Opening and closing the lid causes exposure to a spout from which the user can drink the liquid inside the container.

The buttons function as switches that cause an input at the processor, which triggers controlling of the lid. A motor is connected to the PCB and operates responsive to user input. The motor is connected to a worm and worm gear. The motor's movement transfers to the worm's bi-rotational movement and thereby the worm gear, depending on the motor's directional rotation. When the worm gear rotates, a pivot mechanism causes the lid to pivot to either expose or enclose the spout rotationally.

This Summary is provided to introduce a selection of concepts in a simplified form described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. It will be appreciated that the above-described subject matter may be implemented as a computer-controlled apparatus, a computer process, a computing system, or as an article of manufacture such as one or more computer-readable storage media. These and various other features will be apparent from a reading of the following Detailed Description and a review of the associated drawings.

DESCRIPTION OF THE DRAWINGS

Like reference numerals indicate like elements in the drawings. Elements are not drawn to scale unless otherwise indicated.

DETAILED DESCRIPTION

Figure 1:
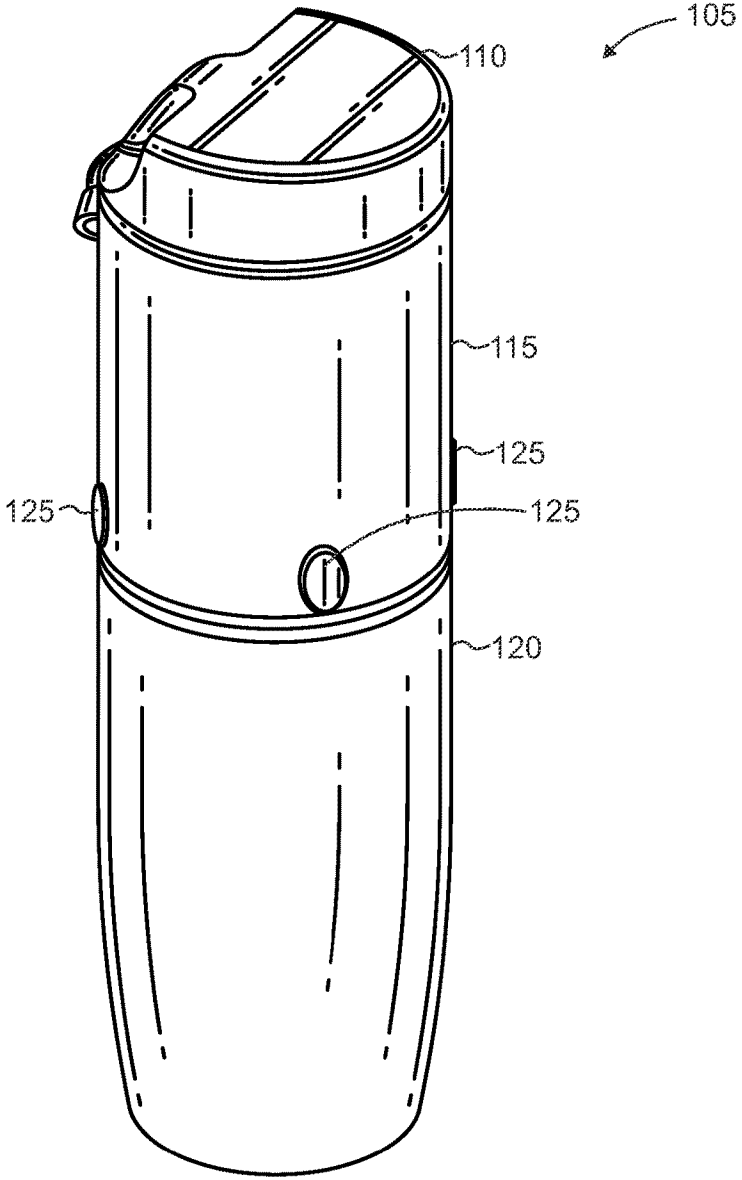
FIG. 1 shows an illustrative representation of an exterior of a sealed cup having an upper container and a lower container.

FIG. 1 shows an illustrative representation in which a sealed cup 105 with an electro-mechanical lid (hereinafter referred to as "cup") is implemented to create and facilitate a cleaner and germ-free environment when a user drinks from a cup. The cup includes a lower container 120, upper container 115 to which the lower container is removably attached, and a lid 110 attached to and positioned on top of the upper container. The cup includes a series of buttons 125 evenly spaced around the upper container's perimeter, which triggers the opening and closing of the lid. The buttons are positioned at various locations around the cup to enhance the user's experience and ease of finding a button to open or close the lid and accommodate left- and right-handed users.

Figure 2:
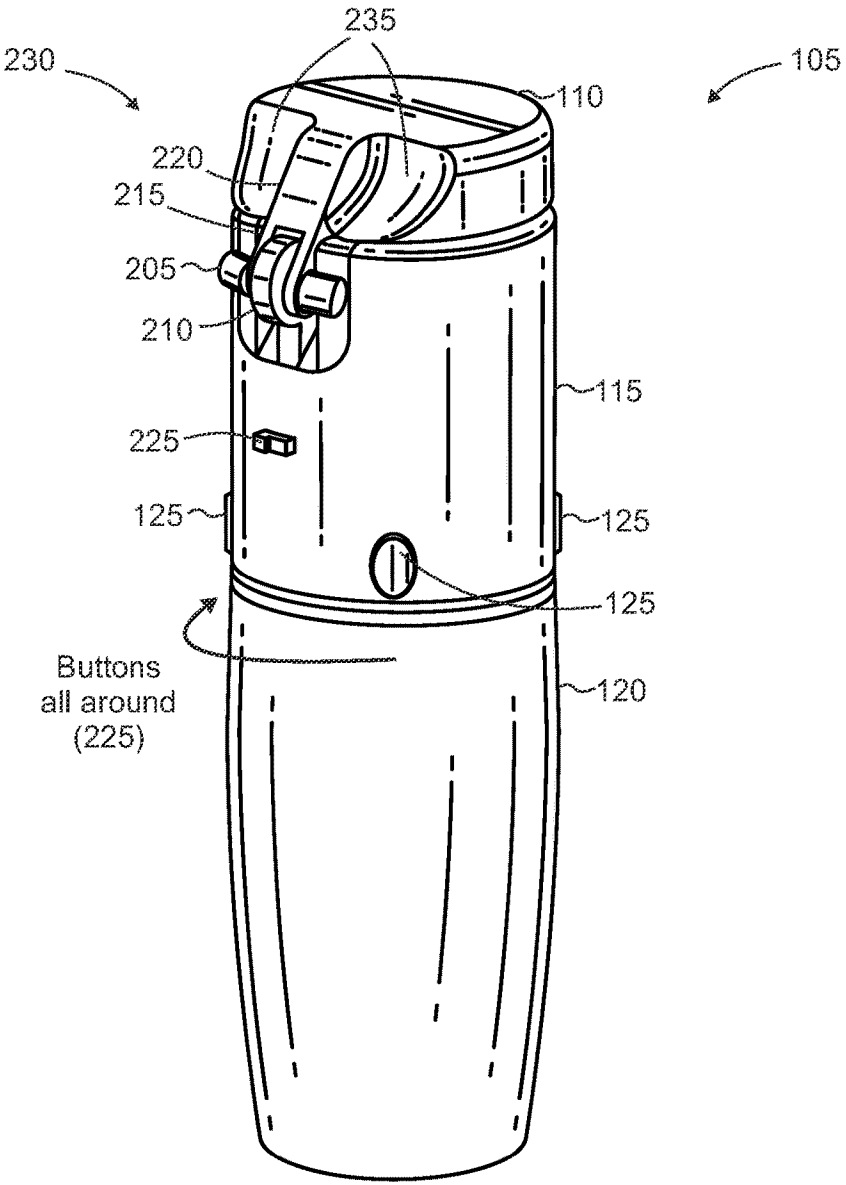
FIG. 2 shows an illustrative representation of the cup having a pivot mechanism about which the lid opens and closes against the upper container.

FIG. 2 shows an illustrative representation in which a rear of the cup 105 is configured with a pivoting mechanism 230 so the cup's lid 110 can open and close the spout (not shown) from which liquid can escape. The pivoting mechanism includes a bridge 220 that connects the bulk of the lid to a connector 215, which wraps around a rod 205 that secures the lid to the cup's upper container 115. A cover 210 is positioned in between the arms of the connector 215 and, as discussed in greater detail below, is implemented to protect a worm gear therein. The connector's arms are connected to the worm gear, which causes the lid to pivot opened and closed responsive to the worm gear's rotational movement. The lid also includes two cutouts 235 on opposite sides of the bridge 220 to accommodate the various outer components when the lid is in the fully opened position. For example, the rod and connector may fit within the cutouts provided so that the lid is not obstructed when opened, thereby allowing a wider opening of the lid.

The rear of the cup 105 also includes a USB (universal serial bus) cover 225 that protects a USB port (not shown) through which an internal battery can charge. Charging the cup's battery allows the electro-mechanical components to operate after the battery is depleted. Around the cup are a series of buttons 125 that are evenly spaced apart, as representatively illustrated by numeral 225. The buttons operate as switches and are used to control the opening and closing of the lid 110. For example, as discussed below, the internal mechanisms of the cup trigger the lid to pivot about the pivoting mechanism 230 responsive to a user clicking on one of the buttons. Pressing the buttons can connect or disconnect a conducting path in which power from the PCB to the motor is initiated. The buttons may otherwise send a signal to the processor to transfer power to the motor. The buttons and USB charging port are positioned on the upper container 115 for proximity to the PCB (Printed Circuit Board).

Figure 3:
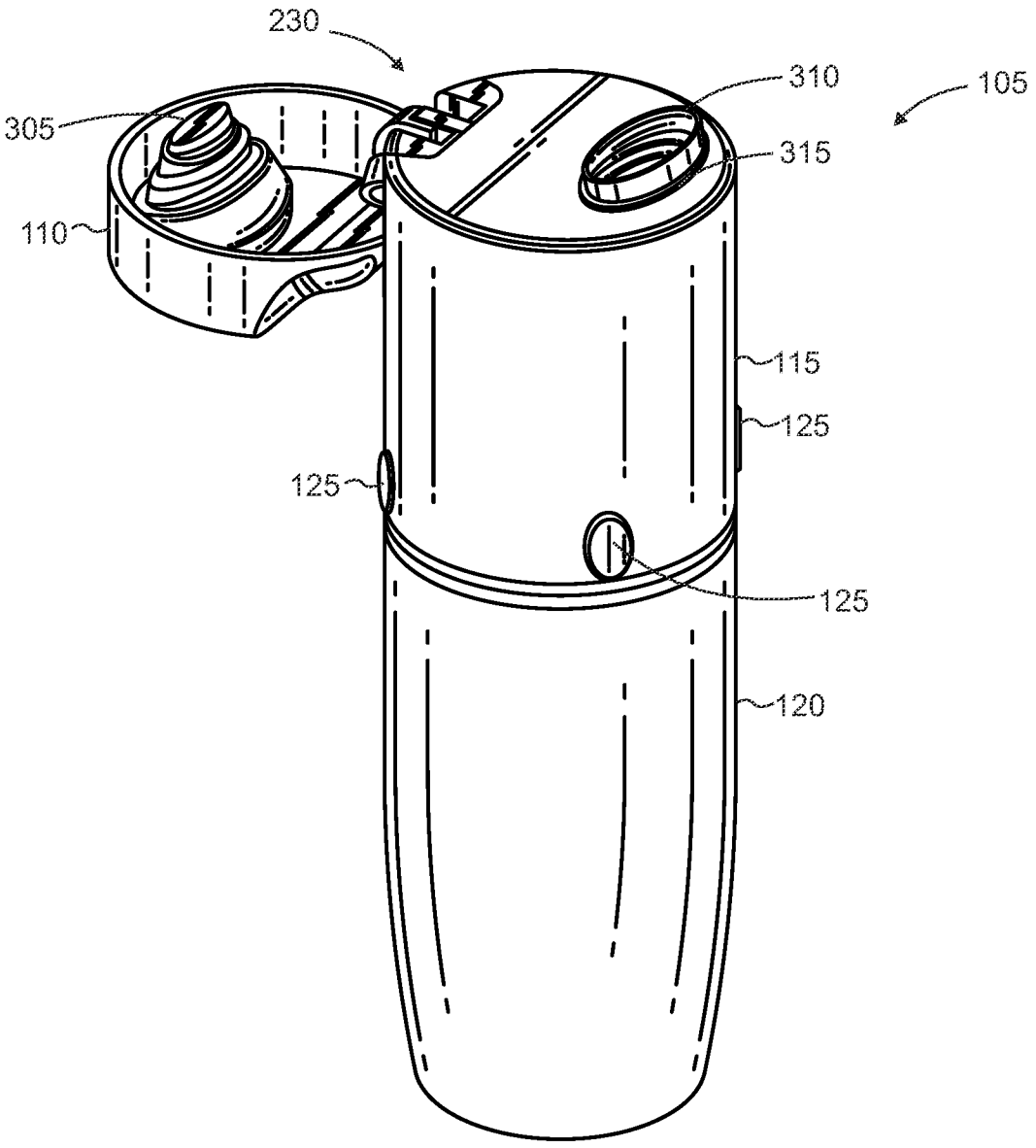
FIG. 3 shows an illustrative representation of the lid in the open position.
Figure 4:
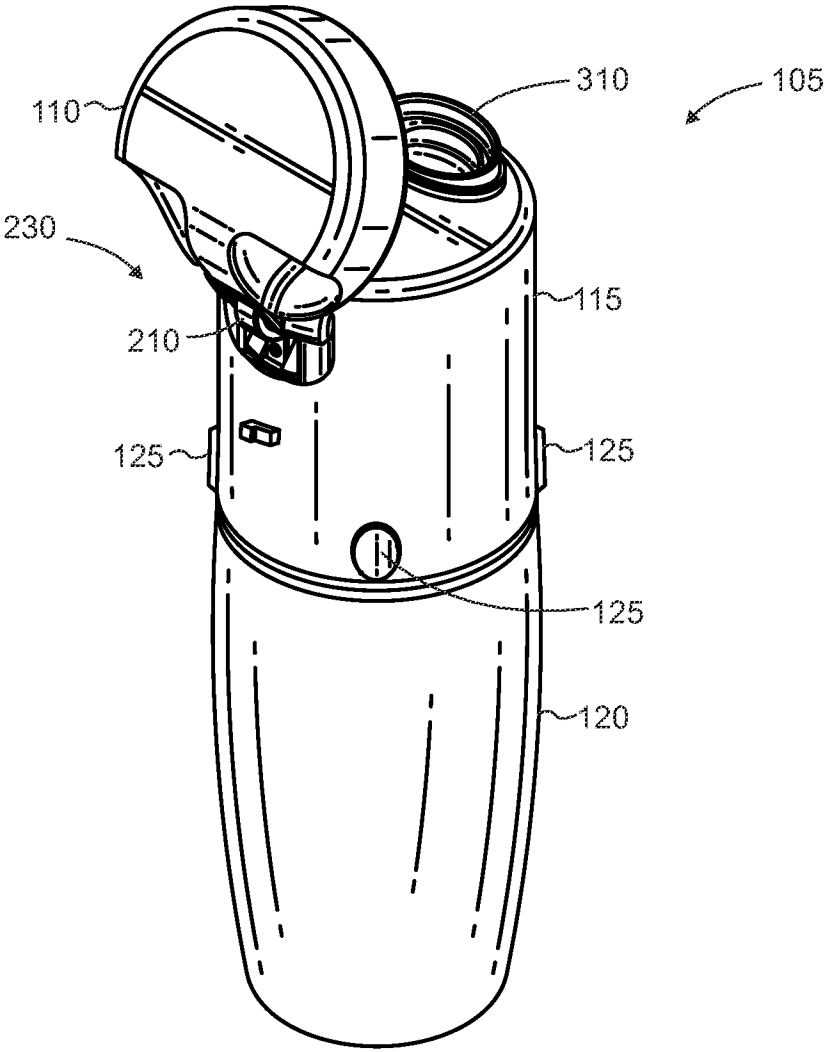
FIG. 4 shows an illustrative representation of the pivot mechanism with the lid in the open position.

FIGS. 3 and 4 show illustrative representations in which the lid 110 of the cup 105 is propped open via the pivoting mechanism 230. On the lid's bottom surface is a silicone seal 305, which protrudes outward and enters the spout 310 when the lid is closed to prevent liquid from escaping. The upper container includes a lip 315 that encircles the spout and extends from an internal container (not shown in FIG. 3 but discussed in greater detail below). The seal includes a series of layers that form a pyramid-like structure that corresponds to the spouts interior to provide a layered-seal.

Figure 5:
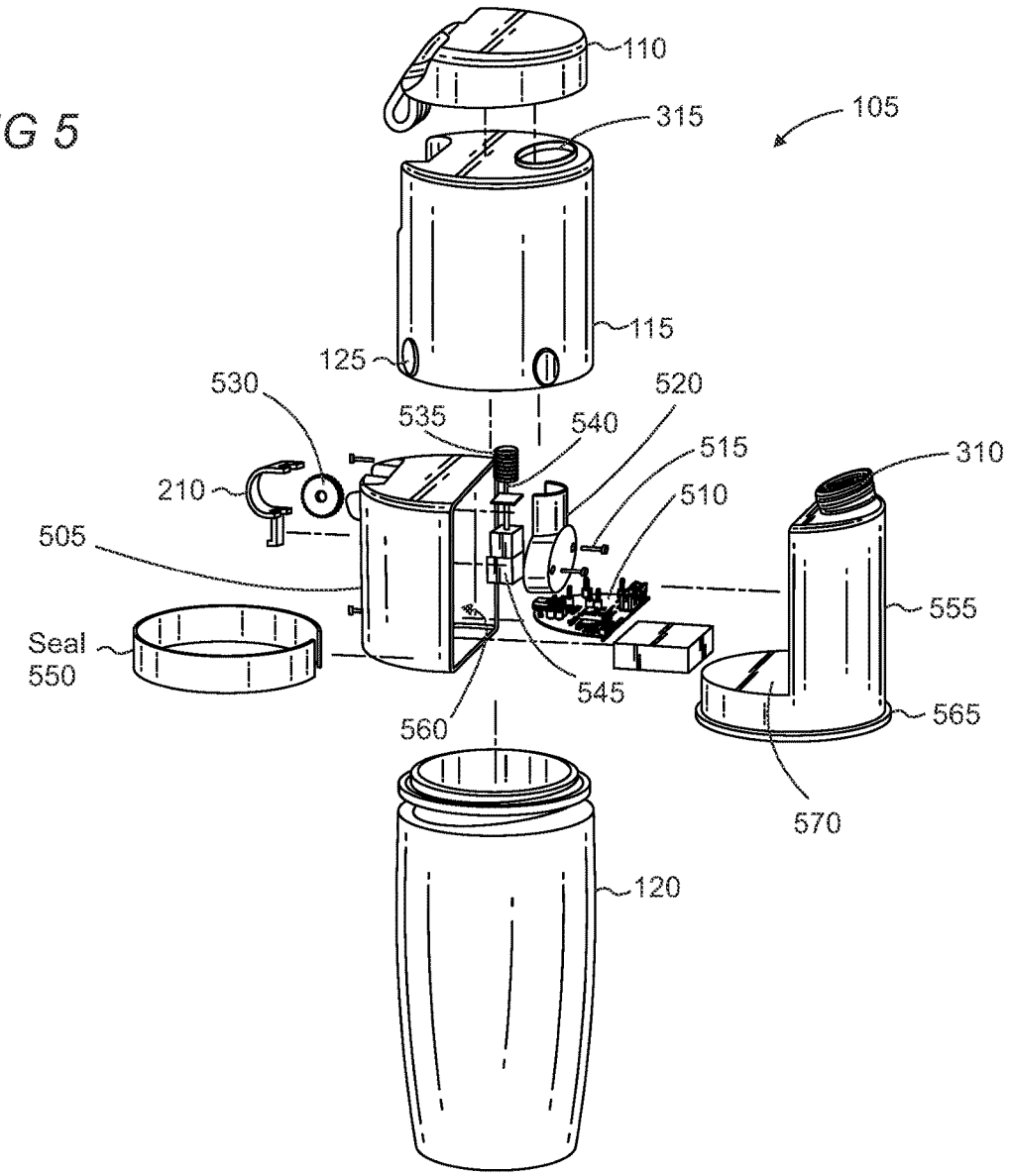
FIG. 5 shows an illustrative exploded representation of the cup's components.

FIG. 5 shows an illustrative exploded view of cup 105 in which an arrangement of the various components is shown. The internal components that fit inside the upper container 115 and lower container 120 are depicted in particular. An internal compartment 505 is positioned adjacent to an internal container 555, and both of which are positioned inside the upper container when the cup is assembled. Specifically, the internal compartment 505 is positioned entirely within the upper container, and most of the internal container is positioned inside the upper container. The base portion 570 includes a lip that rests against the upper container's bottom end. The interior of the base portion 570 may be threaded to enable opening and closing of the assembled upper container (by means of the internal container) to the lower container 120.

The internal container 555 includes the spout 310 that extends upward and through the lip 315 of the upper container. The internal container includes a bottom portion 565, which engages with the lower container's reservoir and provides the entrance point and ultimate flow path for the liquid to exit the upper container 115. The base portion also protects the internal compartment's electrical and mechanical components from engaging with the liquid. A seal 550 is utilized to securely connect the internal compartment 505 to the internal container 555.

The internal compartment 505 includes a cavity 560 inside which at least some of the electrical and mechanical components are stored and secured. A PCB (printed circuit board) 510 is installed, including a battery, microcontroller, or processor, such as a central processing unit (CPU) and memory, among other components. More specifically, an Atmel (Atmega328) microcontroller, or processor, may be used, which is a typical 8-bit general purpose controller. The microcontroller's main functionality is to control the motor's rotation and turn off the power supply when necessary. For example, the microcontroller may trigger the motor's operation for a pre-determined period of time, such as two or three seconds, to open and close the lid 110. In some implementations, a sensor may be utilized which detects pressure or proximity at the lid, such as the lid has encountered the maximum open or closed potential or the lid has reached a pre-set position. The sensor may communicate with the motor or worm gear to detect certain positions or resistance/pressure from the lid. Alternatively, the microcontroller may continuously trigger the motor's operation until the user releases button 125.

In some implementations, a stepper motor may be utilized, which divides the rotation of the gears into a number of steps. The lid's positioning can be determined and controlled based on the number of steps the motor moves. A position sensor in cooperation with the stepper motor thereby determines the number of steps that the motor has moved before stopping the motor's operation. The sensor may be pre-set to detect a certain number of motor rotations and then transmit a signal to the microcontroller when the pre-set number of rotations is met. The microcontroller responsively stops the motor from operating. A similar mechanism and system may work in reverse.

In some implementations, a magnetic reed switch may be utilized in which magnets are positioned at points about the hinge for detecting when the lid is opened and closed. For example, the reed switch can trigger the motor to stop running when the lid opens to a certain degree, and the reed switch detects the magnet. Conversely, the motor can rotate in the reverse until another reed switch detects a magnet that moves with the lid, gear, or some other movable component with the lid's opening. Detecting the magnet causes a sensor to trigger the motor to stop running.

Header pins on the PCB may be used to upload a program into memory, such as using the custom keypad with the microcontroller. The memory can include flash memory, SRAM (Static Random Access Memory), or EEPROM (Electrically Erasable Programmable Read-Only Memory). Uploading the specific software into memory controls how specifically the microcontroller triggers the motor's operation and charges the battery.

A motor 545 may be connected to the PCB to receive electrical power for operations from the battery. The motor includes an output shaft 540 connected to the worm 535 and worm gear 530 so that the rotational movement of the motor translates through the worm gear components. A gear cover 520 is implemented, which partially encapsulates the various worm and worm gear components to protect them from any external damage. The gear cover may be secured using one or more bolts 515 attached to the internal compartment housing. When fully assembled, the internal compartment may fit and rest on the platform of the internal container's base portion 565. In that regard, the internal container's shape, size, and contours are configured to accommodate the electro-mechanical components that operate the cup 105 and lid 110.

Figure 6:
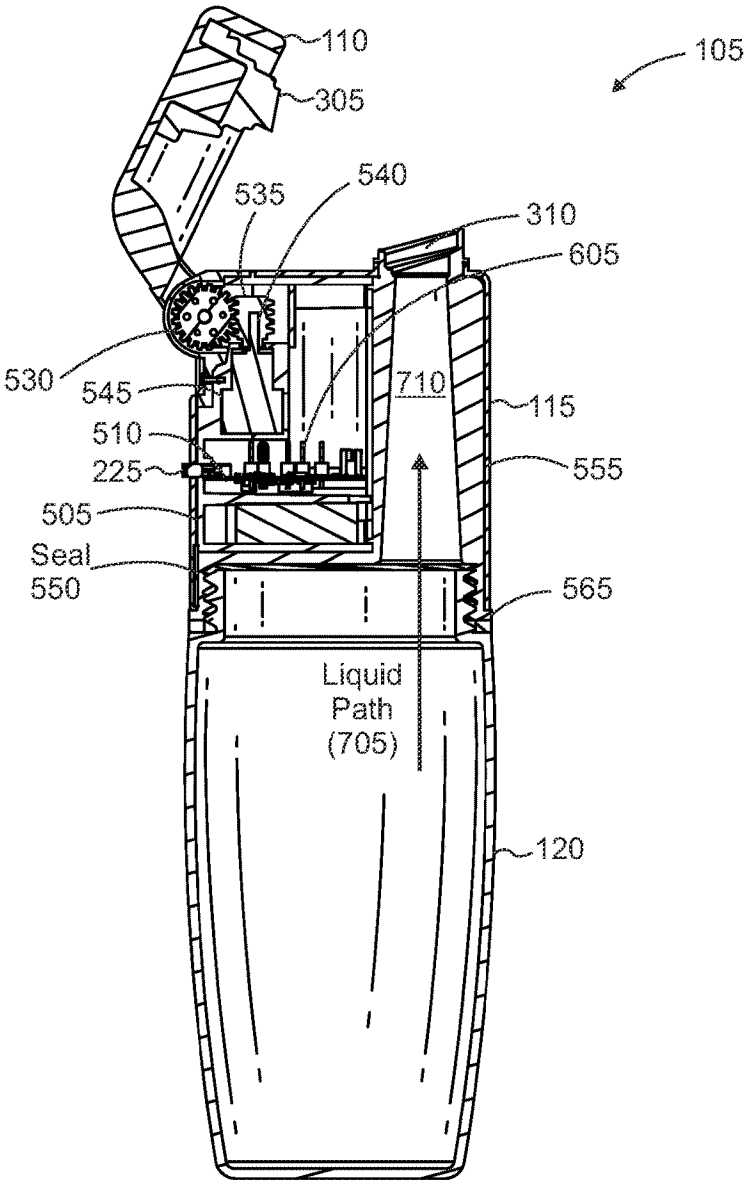
FIG. 6 shows an illustrative cross-sectional representation of the cup to expose the internal components and configurations thereof.

FIG. 6 shows an illustrative representation in which a cross-sectional view of the assembled cup 105 is depicted. As shown, when assembled, the internal compartment 505 is positioned adjacent to the internal container 555, and each of which is positioned, at least in part, inside the upper container 115. The seal 550 securely connects the internal compartment and internal container together. The liquid inside the lower container's reservoir can pass up through the internal container's base portion 565 and internal opening 710 to the spout 310 for user consumption.

The base portion 565 protects the electrical and mechanical components above it and inside the internal compartment 505. The PCB 510 includes various electrical components, including a processor, memory, and a battery for controlling the cup's electro-mechanical mechanism for automatically opening and closing the cup's lid 110. The USB charging port (as identified by cover 225) is adjacent to the PCB for easy charging of the battery through the PCB. The PCB includes various pins 605 that connect to and control various components, such as the motor.

Figure 7:
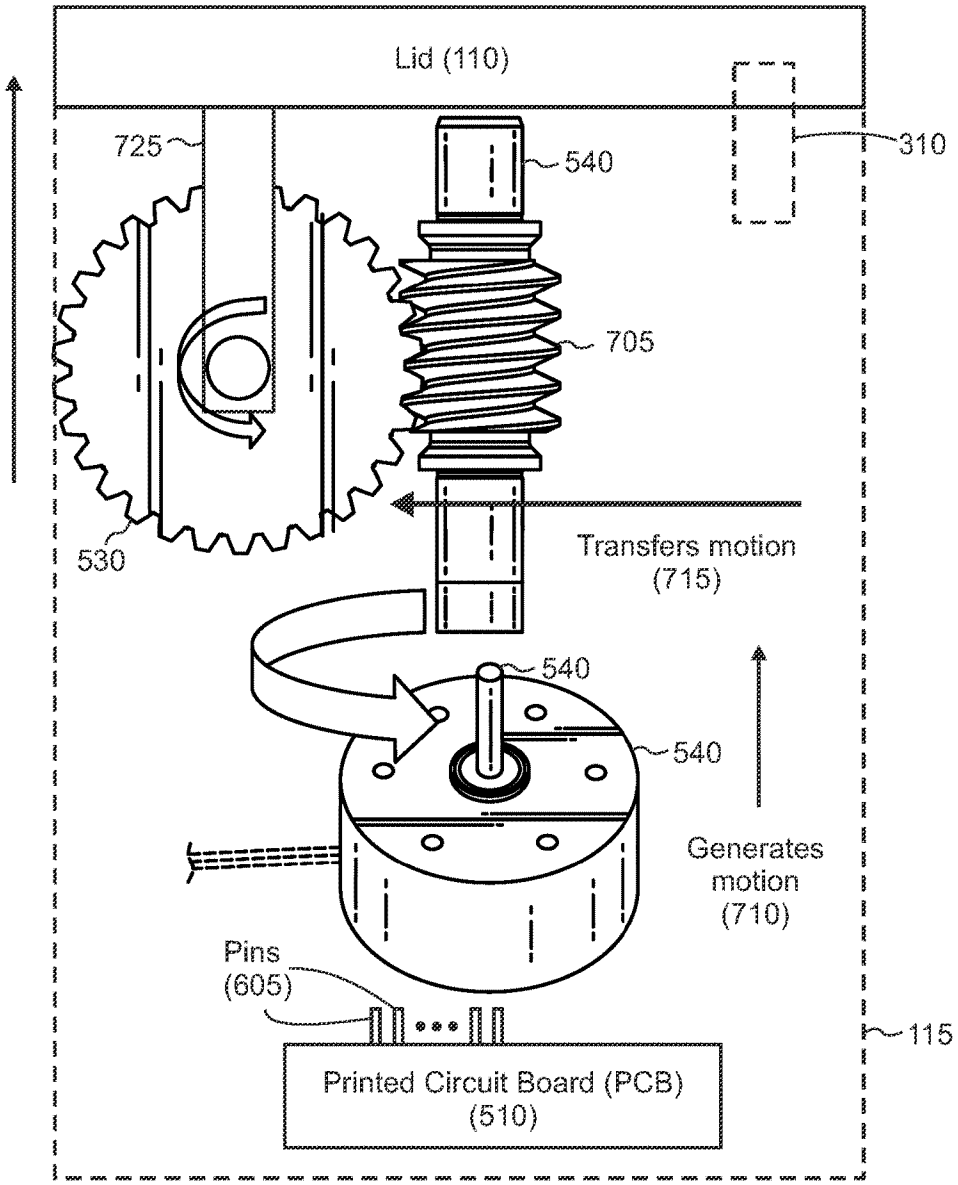
FIG. 7 shows an illustrative representation of the cup's mechanisms which facilitate opening and closing of the lid.

FIG. 7 shows an illustrative schematic representation of the electro-mechanical components to enhance clarity in exposition. FIGS. 6 and 7 may be referenced together to discuss the electro-mechanical components that control the automatic opening and closing of the lid 110. The motor 545 may be connected to pins 605 on the PCB 510 to receive power responsive to user input at one of the buttons 125 (FIGS. 1-5, not shown in FIGS. 6 and 7). In some implementations, the motor may have a wired connection to a PCB pin. The user may press one of the buttons, which function as a switch and which triggers the processor to switch on the motor. The processor may be operatively coupled to memory on the PCB, which stores instructions for the processor to switch on and off the motor. Responsive to user input, the processor triggers the motor to rotate clockwise or counter-clockwise depending on whether the lid 110 is currently propped open or closed. The processor may keep track of the lid's opened or closed position so that it triggers the correct rotational movement. In some implementations, a sensor, such as a pressure or proximity sensor, may identify and keep track of the lid's position, in which case the processor may check the sensor's detected lid positioning before triggering rotational movement in any one direction.

As shown in FIG. 7, the motor generates motion 710 based on its rotational movement. The worm 540 may be attached to the motor's output shaft 540, which causes rotational movement of the worm's threads 705. The worm's threads transfer motion 715 laterally to the worm gear 530, specifically through the worm gear's teeth. The worm gear's rotational movement translates to the propping open of the lid 110, as representatively shown by numeral 720. The arm 725 connects to the lid, either directly or indirectly, so that the worm gear's rotational movement can translate to the opening and closing of the lid, such as at the pivoting mechanism 230. The arm may be, for example, the connector 215 and one of the arms that are attached to the gear's centerpiece, such as via a bolt or screw.

While an electro-mechanical embodiment is discussed herein, other methods and mechanisms may also be used to implement the sealed cup. For example, a cup that is entirely mechanical in nature without any electrical components may be used. The purely mechanical implementation may utilize a similar configuration with the upper, lower, and inner containers and reservoirs to protect the mechanical components from liquid exposure. The mechanical implementation may utilize a spring and locking mechanism that releases the lid responsive to the user pressing one of the buttons 125. For example, a tab adjacent to the spout may latch onto a notch on the lid, in which the tab releases from the notch when the user presses one of the buttons. Each button may be connected to an extension that gets pushed inward when the user presses the button. The inward movement is sufficient to cause the tab to release from the notch, such as pull the tab downward. Once the lid opens, the user can manually press down the lid to seal the spout using the tab and notch mechanism.

Alternatively, a purely mechanical implementation may operate with a constant-closing mechanism. The user may press one of the buttons which causes the lid to prop open and automatically close when the user releases the button. Thus, the lid opens when the user presses and holds the button, and then closes when the user releases the button. This implementation can help prioritize that the spout and the cup's contents are protected from bacteria and germs. The lid's hinge may be spring-loaded so that it keeps the lid closed. Pressing the button can release the spring and cause rotational movement of the hinge and thereby the lid. For example, the buttons may be connected to an extension which affects the spring's tension in an opposite direction, thereby causing the lid to open. The mechanical implementations may, alternatively, be implemented using the electro-mechanical components, in which the processor can be configured to execute instructions that implement these implementations, such as keeping the lid open until and while the user holds down one of the buttons.

Figure 8:
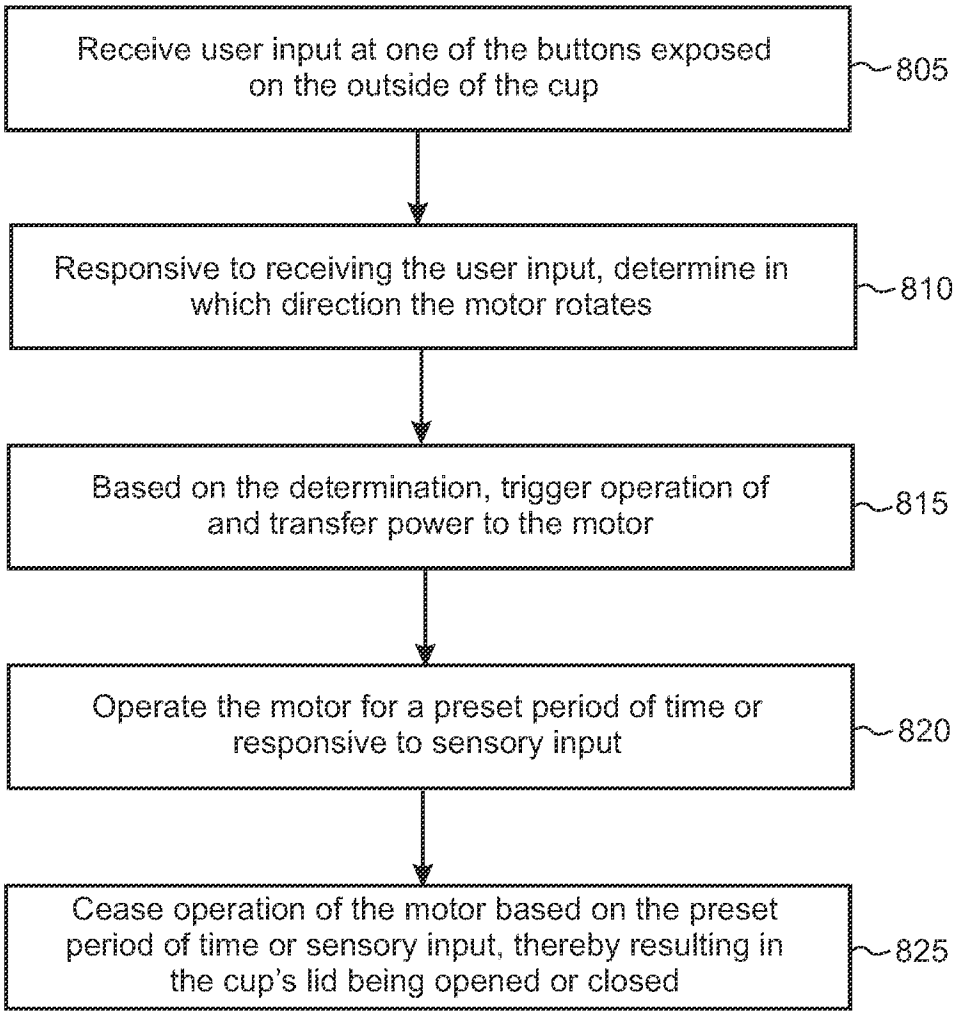
FIG. 8 shows a flowchart of an illustrative method performed by the cup's electro-mechanical components.

FIG. 8 shows an illustrative method that may be performed by the various electro-mechanical devices inside of the cup, such as by the processor. In step 805, the cup receives user input at one of the buttons exposed on the outside of the cup. In step 810, responsive to receiving the user input at the button, the cup determines the direction the motor rotates. The determination may be based on, for example, in what position the lid is in currently, such that an opened lid would cause the motor to rotate in the direction to close the lid. In step 815, based on the determination regarding which direction to operate the motor, the cup triggers operation of and transfers power to the motor. In step 820, the cup operates the motor for a pre-set period of time or responsive to sensory input. In step 825, the cup ceases operations of the motor based on the pre-set period of time or sensory input, thereby resulting in the cup's lid being opened or closed.

Figure 9:
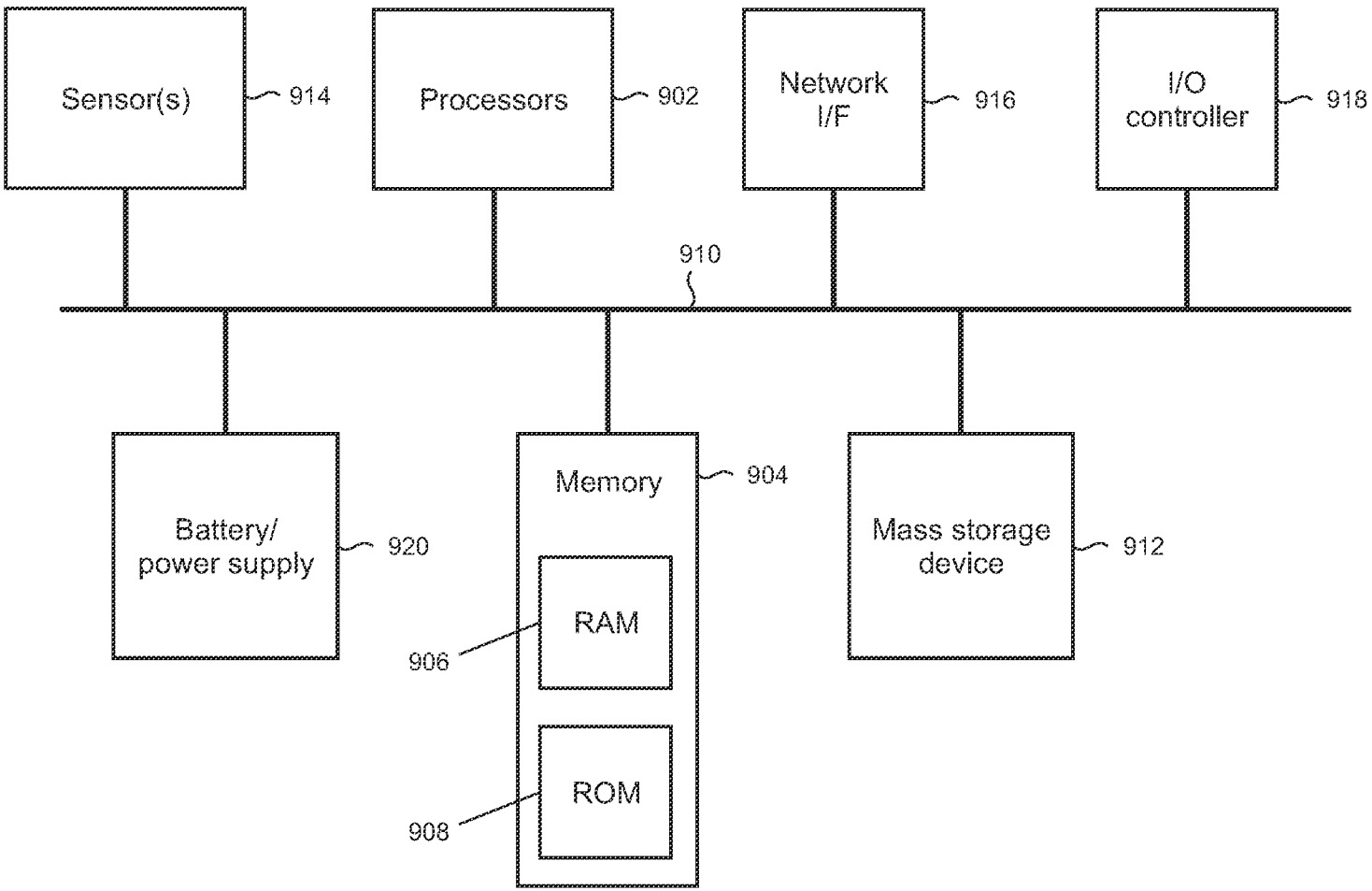
FIG. 9 is a simplified block diagram of an illustrative architecture of a computing device that may be used at least in part to implement the present sealed cup with an electro-mechanical lid.

FIG. 9 shows an illustrative architecture 900 for computing device components that may be utilized inside the cup, such as with the PCB, for the present implementation. The architecture 900 illustrated in FIG. 9 includes one or more processors 902 (e.g., central processing unit), a system memory 904, including RAM (random access memory) 906 and ROM (read-only memory) 908, and a system bus 910 that operatively and functionally couples the components in the architecture 900. A basic input/output system containing the basic routines that help transfer information between elements within the architecture 900, such as during startup, is typically stored in the ROM 908. The architecture 900 further includes a mass storage device 912 for storing software code or other computer-executed code utilized to implement applications, the file system, and the operating system. The mass storage device 912 is connected to processor 902 through a mass storage controller (not shown) connected to bus 910. The mass storage device 912 and its associated computer-readable storage media provide non-volatile storage for the architecture 900. Although the description of computer-readable storage media contained herein refers to a mass storage device, such as a hard disk or CD-ROM drive, it may be appreciated by those skilled in the art that computer-readable storage media can be any available storage media that can be accessed by the architecture 900.

By way of example, and not limitation, computer-readable storage media may include volatile and non-volatile, removable and non-removable media implemented in any method or technology for storage of information such as computer-readable instructions, data structures, program modules, or other data. For example, computer-readable media includes, but is not limited to, RAM, ROM, EPROM (erasable programmable read-only memory), EEPROM (electrically erasable programmable read-only memory), Flash memory or other solid-state memory technology, CD-ROM, DVD, HD-DVD (High Definition DVD), Blu-ray, or other optical storage, a magnetic cassette, magnetic tape, magnetic disk storage or other magnetic storage device, or any other medium which can be used to store the desired information and which can be accessed by the architecture 900.

According to various embodiments, the architecture 900 may operate in a networked environment using logical connections to remote computers through a network. The architecture 900 may connect to the network through a network interface unit 916 connected to the bus 910. It may be appreciated that the network interface unit 916 also may be utilized to connect to other types of networks and remote computer systems. The architecture 900 also may include an input/output controller 918 for receiving and processing input from a number of other devices, including a keyboard, mouse, touchpad, touchscreen, control devices such as buttons and switches, or electronic stylus (not shown in FIG. 9). Similarly, the input/output controller 918 may provide output to a display screen, user interface, a printer, or other type of output device (also not shown in FIG. 9).

It may be appreciated that the software components described herein may, when loaded into processor 902 and executed, transform the processor 902 and the overall architecture 900 from a general-purpose computing system into a special-purpose computing system customized to facilitate the functionality presented herein. The processor 902 may be constructed from any number of transistors or other discrete circuit elements, which may individually or collectively assume any number of states. More specifically, the processor 902 may operate as a finite-state machine in response to executable instructions contained within the software modules disclosed herein. These computer-executable instructions may transform the processor 902 by specifying how the processor 902 transitions between states, thereby transforming the transistors or other discrete hardware elements constituting the processor 902.

Encoding the software modules presented herein also may transform the physical structure of the computer-readable storage media presented herein. The specific transformation of physical structure may depend on various factors in different implementations of this description. Examples of such factors may include, but are not limited to, the technology used to implement the computer-readable storage media, whether the computer-readable storage media is characterized as primary or secondary storage, and the like. For example, if the computer-readable storage media is implemented as semiconductor-based memory, the software disclosed herein may be encoded on the computer-readable storage media by transforming the physical state of the semiconductor memory. For example, the software may transform the state of transistors, capacitors, or other discrete circuit elements constituting the semiconductor memory. The software may also transform the physical state of such components to store data thereupon.

As another example, the computer-readable storage media disclosed herein may be implemented using magnetic or optical technology. In such implementations, the software presented herein may transform the physical state of magnetic or optical media when the software is encoded therein. These transformations may include altering the magnetic characteristics of particular locations within given magnetic media. These transformations also may include altering the physical features or characteristics of particular locations within given optical media to change the optical characteristics of those locations. Other transformations of physical media are possible without departing from the scope and spirit of the present description, with the foregoing examples provided only to facilitate this discussion.

The architecture 900 may further include one or more sensors 914 or a battery or power supply 920. The sensors may be coupled to the architecture to pick up data about an environment or a component, including temperature, pressure, etc. Exemplary sensors can include a thermometer, accelerometer, smoke or gas sensor, pressure sensor (barometric or physical), light sensor, ultrasonic sensor, gyroscope, among others. The power supply may be adapted with an AC power cord or a battery, such as a rechargeable battery for portability.

In light of the above, it may be appreciated that many types of physical transformations take place in architecture 900 in order to store and execute the software components presented herein. It also may be appreciated that the architecture 900 may include other types of computing devices, including wearable devices, handheld computers, embedded computer systems, smartphones, PDAs, and other types of computing devices known to those skilled in the art. It is also contemplated that the architecture 900 may not include all of the components shown in FIG. 9, may include other components that are not explicitly shown in FIG. 9, or may utilize an architecture completely different from that shown in FIG. 9.

Various embodiments of the electro-mechanical cup are disclosed. In one exemplary embodiment, an electro-mechanical cup comprises: a lower container; an upper container that removably attaches to the lower container; a lid attached to and positioned on top of the upper container; an internal container that fits within the upper container, wherein the internal container provides a flow path from the lower container to the upper container; an internal compartment positioned laterally to the internal container and which stores various electrical components that facilitate electro-mechanical opening and closing of the lid, wherein the internal container separates the internal compartment from the lower container to protect the electrical components from touching liquid stored inside the lower container; and a PCB (printed circuit board) positioned at least partially inside the internal compartment, wherein the PCB includes a hardware-based memory device and a processor that controls opening and closing of the lid against the upper container.

In another embodiment, the internal compartment is adjacent to the internal container. As a further embodiment, the cup further comprises a seal that partially encapsulates and secures the internal compartment to the internal container. In another example, the internal container includes a spout which provides the flow path from the lower container to the upper container, wherein the spout extends beyond a top surface of the upper container to provide a full seal between the lower container through and out of the upper container, and thereby prevent liquid from engaging with components inside the internal compartment. As another example, the lid includes a silicone seal that protrudes from the lid and extends into the spout when the lid is closed. In a further embodiment, the cup further comprises: a battery connected to and which provides power to the PCB and its connected components; a motor connected to the PCB; a worm connected to the motor, the worm having a series of threads; a worm gear which engages with the threads on the worm; a pivot mechanism that connects the worm gear to the lid, wherein motion generated by the motor translates through the worm and worm gear components and causes the pivot mechanism to prop open the lid. As a further embodiment, the cup further comprises a gear cover loosely shaped to accommodate a size and shape of the motor, worm, and worm gear, in which the gear cover at least partially encloses the motor, worm, and worm gear for protection. As another example, the gear cover is connected to an inside wall of the internal compartment. In another example, the gear cover is connected to the internal compartment using one or more bolts or screws. As a further example, the cup further comprises one or more buttons positioned on the upper container, wherein the buttons are connected to the PCB, in which input at the buttons causes the processor to trigger opening or closing of the lid. As another example, multiple buttons are evenly spaced around a perimeter of the upper container. As another example, the buttons operate as switches which trigger an input to the processor to open or close the lid. In a further embodiment, the motor operates as a stepper motor which stops operating upon reaching a pre-set number of gear rotations. A further embodiment comprises a sensor which detects the number of gear rotations.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. An electro-mechanical cup; comprising:

a lower container;

an upper container that removably attaches to the lower container;

a lid attached to the upper container;

an internal container that fits within the upper container, wherein the internal container provides a flow path from the lower container to the upper container, a bottom portion of the internal container engages with the lower container, and a spout of the internal container extends beyond a top surface of the upper container;

an internal compartment positioned laterally to the internal container that rests on top of a base of the internal container, the internal compartment being positioned entirely within the upper container, wherein the internal compartment stores various electrical components that facilitate electro-mechanical opening and closing of the lid, wherein the internal container separates the internal compartment from the lower container to protect the electrical components from touching liquid stored inside the lower container; and a PCB (printed circuit board) positioned at least partially inside the internal compartment, wherein the PCB includes a hardware-based memory device and a processor that controls opening and closing of the lid against the upper container.

2. The electro-mechanical cup of claim 1, wherein the internal compartment is adjacent to the internal container.

3. The electro-mechanical cup of claim 2, further comprising a seal which partially encapsulates and secures the internal compartment to the internal container.

4. The electro-mechanical cup of claim 3, wherein the internal container's spout provides the flow path from the lower container to the upper container, wherein the spout extends beyond a top surface of the upper container to provide a full seal between the lower container through and out of the upper container, and thereby prevent liquid from engaging with components inside the internal compartment.

5. The electro-mechanical cup of claim 4, wherein the lid includes a silicone seal which protrudes from the lid and extends into the spout when the lid is closed.

6. The electro-mechanical cup of claim 1, further comprising:

a battery connected to and which provides a power to the PCB and its connected components;

a motor connected to the PCB;

a worm connected to the motor, the worm having a series of threads;

a worm gear which engages with the threads on the worm; and a pivot mechanism that connects the worm gear to the lid, wherein motion generated by the motor translates through the worm and worm gear components and causes the pivot mechanism to prop open the lid.

7. The electro-mechanical cup of claim 6, further comprising a gear cover loosely shaped to accommodate a size and shape of the motor, worm, and worm gear, in which the gear cover at least partially encloses the motor, worm, and worm gear for protection.

8. The electro-mechanical cup of claim 7, wherein the gear cover is connected to an inside wall of the internal compartment.

9. The electro-mechanical cup of claim 8, wherein the gear cover is connected to the internal compartment using one or more bolts or screws.

10. The electro-mechanical cup of claim 6, further comprising one or more buttons positioned on the upper container, wherein the buttons are connected to the PCB, in which input at the buttons causes the processor to trigger opening or closing of the lid.

11. The electro-mechanical cup of claim 10, wherein multiple buttons are evenly spaced around a perimeter of the upper container.

12. The electro-mechanical cup of claim 10, wherein the buttons operate as switches which trigger an input to the processor to open or close the lid.

13. The electro-mechanical cup of claim 6, wherein the motor operates as a stepper motor which stops operating upon reaching a pre-set number of gear rotations.

14. The electro-mechanical cup of claim 13, further comprising a sensor which detects the number of gear rotations.

* * * * *